US007832122B2

(12) United States Patent
Rhenter

(10) Patent No.: US 7,832,122 B2
(45) Date of Patent: Nov. 16, 2010

(54) SHOE HEEL CUP AND SHOE EQUIPPED WITH ONE SUCH HEEL CUP

(76) Inventor: Jean-Luc Rhenter, Route du Village, Bursinel (CH) CH-1195

( * ) Notice: Subject to any disclaimer, the term of this patent is extended or adjusted under 35 U.S.C. 154(b) by 953 days.

(21) Appl. No.: 11/569,826

(22) PCT Filed: May 31, 2005

(86) PCT No.: PCT/FR2005/001327

§ 371 (c)(1),
(2), (4) Date: Nov. 30, 2006

(87) PCT Pub. No.: WO2005/117642

PCT Pub. Date: Dec. 15, 2005

(65) Prior Publication Data

US 2008/0034616 A1 Feb. 14, 2008

(30) Foreign Application Priority Data

Jun. 1, 2004 (FR) ..... 04 06086

(51) Int. Cl.
*A43B 23/08* (2006.01)

(52) U.S. Cl. ..... 36/69

(58) Field of Classification Search ..... 36/69, 36/68, 89, 92

See application file for complete search history.

(56) References Cited

U.S. PATENT DOCUMENTS

| | | | | |
|---|---|---|---|---|
| 3,807,062 | A | 4/1974 | Spier | |
| 6,018,892 | A * | 2/2000 | Acheson et al. | 36/89 |
| 6,083,184 | A | 7/2000 | Kenosh | |
| 6,126,626 | A | 10/2000 | Duback | |
| 6,230,423 | B1 * | 5/2001 | Donnelly | 36/117.6 |
| 6,270,468 | B1 | 8/2001 | Townsend | |
| 2002/0162250 | A1 | 11/2002 | Campbell | |
| 2006/0053662 | A1 * | 3/2006 | Yang | 36/115 |

FOREIGN PATENT DOCUMENTS

FR 2662916 A1 12/1991

* cited by examiner

*Primary Examiner*—Ted Kavanaugh
(74) *Attorney, Agent, or Firm*—William H. Eilberg

(57) ABSTRACT

A heel cup can be inserted into a shoe in order to define a posterior upward projection and lateral wings which surround the posterior and lateral faces of the calcaneum and which, through lateral notches, define a preferential deformation zone at, and in the direction of, the subtalar cone of the tibiotarsal joint. Moreover, a sufficiently-rigid connecting zone connects the posterior upward projection and the lateral wings, thus providing the shoe with good stability while enabling inversion and eversion foot movements. In this way, comfort is increased considerably, while the risk of articular injuries is reduced since the subtalar articulation is contained correctly upon reaching the limit thereof.

5 Claims, 4 Drawing Sheets

SHOE HEEL CUP AND SHOE EQUIPPED WITH ONE SUCH HEEL CUP

TECHNICAL FIELD OF THE INVENTION

The present invention concerns footwear and more particularly, although not exclusively, multipurpose sports shoes, walking shoes, orthopedic shoes.

Whatever the application concerned, shoes must assume different functions and in particular a function of mechanical protection of the sensitive portions of the foot against impact and a function of holding or supporting the foot and ankle joints.

To fulfill their function of impact protection, shoes must in particular protect the heel and the area of attachment of the Achilles tendon.

To fulfill their function of holding or supporting the joints, shoes must in particular limit the forces on the ankle and foot joints when they are close to their maximum amplitude of movement.

However, a shoe must simultaneously allow free functioning of the ankle and foot joints for the various movements of walking, running, jumping, turning.

Clearly there is a contradiction between the necessity to protect and to support the ankle and foot joints, on the one hand, and the simultaneous necessity to allow freedom of movement of the joints of the foot and the ankle. In fact, protection and support of the joints are obtained in principle by providing rigid members incorporated into the shoe while freedom of movement necessitates the use of flexible uppers in the construction of the shoe.

Thus any attempt to stiffen the structure of the uppers of the shoe improves the support of the joints, to the detriment of comfort, i.e. to the detriment of the freedom of movement of the joints. Conversely, improving comfort entails increasing the flexibility of the structure of the uppers of the shoe, but, this time, to the detriment of the functions of supporting the joints and protecting the foot and the ankle.

There have therefore already been proposed sports shoes consisting in a sole to which is fixed a flexible upper covering the foot and the heel. Such shoes simply provide flexible containment of a portion of the calcaneo-pedal block. The use of such shoes has been generalized to many sporting activities such as tennis, football, athletics, jogging. The design of this type of shoe is not intended to provide containment of the joints of the foot and a fortiori the ankle.

There have also been proposed sports shoe types known as high-leg shoes, i.e. shoes including not only a pedal cup but also a flexible vamp or upper providing containment of all of the foot and ankle joints.

Shoes constructed in accordance with this principle are used in many sports such as basketball, football, tennis. The upper of these shoes is flexible so that they provide flexible support and containment. Such shoes therefore do not provide effective protection of the ankle joint in the event of twisting when participating in sports. The ankle joint is in fact insufficiently supported in the event of unexpected twisting, which leads to distension of the sub-astragalus ligaments possibly followed by distension of the tibio-tarsal ligaments.

In the case of walking shoes, and more particularly shoes intended for mountaineering, the containment of the ankle joints is provided in a quasirigid manner. The protection is effective, but comfort is reduced.

To improve comfort in the presence of shoes with rigid shell portions providing good protection, it has also been proposed to provide an articulation area between the vamp and the upper, the aim of the articulation being to facilitate the movements of the natural foot and ankle joints. However, although the design of these articulations is relatively well suited to enabling the natural physiological movement of transverse axis rotation of the tibio-tarsal joint, these structures cannot at the same time effectively contain and allow free physiological movements of the sub-astragalus joint of the ankle. This then results either in a lack of comfort or in a lack of protection of the joint, or even a risk of aging and premature failure of the shoe articulation area.

In the field of athletics, there has also been proposed, in the document U.S. Pat. No. 6,126,626 A, an ankle brace that can be adapted by molding to an ankle, forming an assembly that is structurally independent of a shoe but that the user can nevertheless wear when inserting the foot into a shoe. The ankle brace is attached to the ankle by laces and is not fixed to the shoe. It is made from a sheet the upper edge whereof is free of cutouts. Placed around the ankle, the ankle brace has lateral openings situated below the lateral projections of the sub-astragalus cone of the ankle. This structure aims to prevent the normal physiological movements of eversion and inversion, and this reduces freedom of movement and comfort.

The document U.S. Pat. No. 3,807,062 A describes an athletics shoe including a relatively rigid sheet in the heel area. This sheet surrounds the posterior portion of the foot from the base up to a point above the calcaneum and its lower edge is fixed to the sole of the shoe. Two symmetrical lateral cutouts are oriented horizontally and situated well above the lateral projections of the sub-astragalus cone of the ankle. The calcaneum is not surrounded laterally in its entirety. Comfort and protection remain insufficient.

SUMMARY OF THE INVENTION

The problem addressed by the present invention is improving both the comfort and the safety of shoes, thereby avoiding the drawbacks of traditional shoes, so as to support the natural foot and ankle joints without compromising comfort.

Another object of the invention is to propose a particularly simple and inexpensive structure that enables simultaneous improvement of protection and comfort.

To achieve this, the invention exploits the results of an in-depth study of the natural physiological movements of the foot and ankle joints and of the movements of the different portions of the foot relative to the shoe during movements such as walking, running, jumping and turning.

It has become apparent in this way that traditional shoes are not sufficiently well adapted to the physiological movements of the foot and ankle joints, and that this is what explains either the lack of comfort or the lack of protection, or even the risk of rapid deterioration of the shoe.

To achieve the above and other objects, the invention proposes a shoe heel cup comprising an elastically deformable material sheet of appropriate high stiffness conformed to surround the posterior portion of the foot and cover at least the whole of the posterior face of the foot from its base to a point above the calcaneum and extending forwardly, with its lower edge adapted to be fixed to the shoe sole, the sheet comprising, in its upper edge, two lateral cutouts that are symmetrical with respect to each other; the lateral cutouts are oriented so that, when the heel cup is in place in the shoe, the lateral cutouts are substantially at the level of the lateral projections of the sub-astragalus cone and the sheet laterally surrounds the calcaneum.

The heel cup constructed in this way is a particularly simple and inexpensive item and its use in a shoe considerably improves the trade-off achieved between the necessities of protecting the heel and the joints and the necessities of comfort resulting from a great freedom of movement of the joints.

The lateral cutouts preferably have a V-shape that diverges towards the front and towards the top of the shoe. This favors elastic deformation of the enveloping area between the edges of the lateral cutouts.

The aperture angle of the V-shaped lateral cutouts may advantageously be greater than the angle of the sub-astragalus cone, which effectively frees the movements of inversion and eversion of the ankle.

Cutouts having greater or lesser depths could be envisaged. The depth of the lateral cutouts is preferably such that, when the heel cup is in place in the shoe, the bottom of the lateral cutouts is slightly to the rear of the sub-astragalus joint. This achieves a good trade-off between the comfort resulting from the presence of the lateral cutouts and the protection resulting from the posterior portion of the cup being free of cutouts and absorbing mechanical forces.

For a shoe size 42, the heel cup may advantageously be made from a sheet of material delimited by a slightly convex lower edge of length from approximately 12 to 16 cm and by a more strongly convex upper edge including the two lateral cutouts, the central area of the sheet having a height from approximately 4 to 7 cm.

Another aspect of the invention proposes a shoe including:

a sole, an upper fixed to the sole and adapted to envelop the plantar mass of the foot and the calcaneo-pedal block, a vamp connected to the posterior portion of the upper and adapted to envelop at least the rear upper area of the foot, a more rigid material heel cup having a lower edge fixed to the sole and conformed to surround the posterior portion of the foot and cover at least the whole of the posterior face of the foot from its base to a point above the calcaneum and to surround the calcaneum laterally, the heel cup being as defined hereinabove and producing a one-piece reinforcement consisting of a posterior tongue and two lateral wings.

In a first application, the invention may be used in a shoe including an upper and a vamp that are relatively flexible, the heel cup being made from an elastically deformable material more rigid than the upper and the vamp.

In a second application, the invention may be used in a shoe having an essentially rigid upper, an essentially rigid vamp, and a more flexible upper and/or vamp portion in the area of the lateral cutouts of the heel cup, the heel cup itself being made from a material more rigid than the upper portion and/or the vamp portion situated in the area of the lateral cutouts.

At least in the area of the lateral cutouts, the upper and/or the vamp may advantageously constitute an elastic deformation area of lower stiffness.

In all embodiments, the heel cup adapted to be inserted in a shoe defines a posterior tongue and lateral wings that envelop the posterior face and the lateral faces of the calcaneum, at the same time as providing, by means of lateral cutouts, an area of preferential deformation situated at the level of and in the direction of the sub-astragalus cone of the foot joint.

BRIEF DESCRIPTION OF THE DRAWINGS

Other objects, features and advantages of the present invention will emerge from the following description of particular embodiments, given with reference to the appended figures, in which.

DESCRIPTION OF THE PREFERRED EMBODIMENTS

Figure 5:
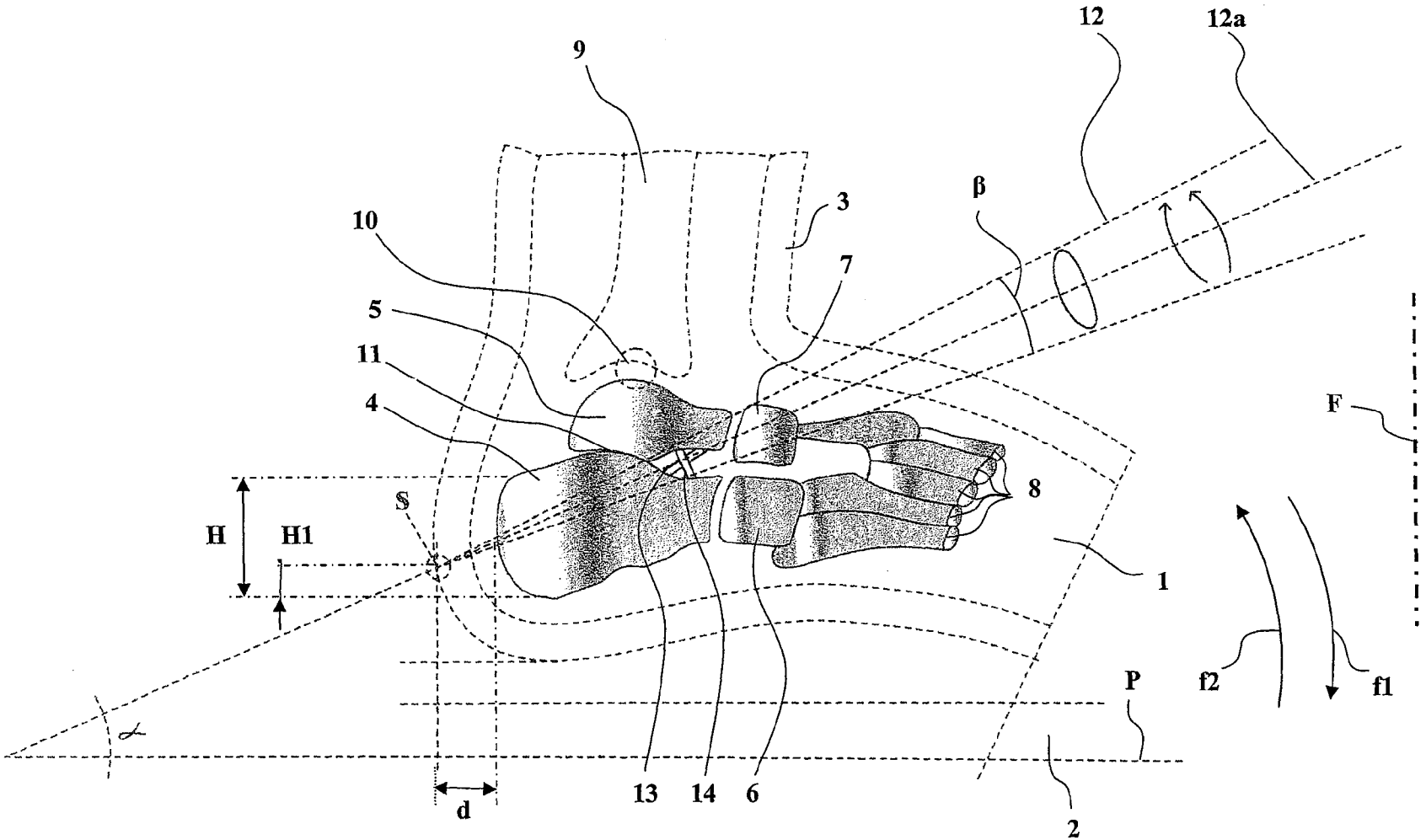
FIG. 5 is a diagrammatic lateral external view of the ankle and foot joint in a traditional shoe provided with a rigid or flexible upper.

FIG. 5 is considered first, in order to outline the main structural components of a foot joint and the main movements of that joint.

The foot 1 is represented in a shoe consisting of a sole 2 and an exterior upper 3 represented in dashed lines.

The sole 2 of the shoe is resting on a horizontal plane P and the shoe extends longitudinally along a vertical plane perpendicular to the plane P, or plane of the figure.

Of the foot 1, shown inside the shoe, there are seen the calcaneum 4, the astragalus 5, the cuboid 6, the scaphoid 7 and the cuneiforms 8 that are followed by the metatarsals and the phalanges, not shown.

The calcaneo-pedal block, consisting of the calcaneum 4, the cuboid 6, the scaphoid 7 and the cuneiforms 8, forms the lower structure of the foot, which rests on the sole 2 of the shoe.

This calcaneo-pedal block is articulated to the bottom of the leg, indicated by the lower end of the tibia 9, by a joint with two successive stages, namely a tibio-tarsal joint 10 between the tibia 9 and the astragalus 5, and a sub-astragalus joint 11 between the astragalus 5 and the calcaneum 4.

The tibio-tarsal joint 10 enables movement of the foot in the sagittal plane, i.e. in rotation about a transverse axis perpendicular to the plane of the figure, for example to raise or lower the anterior end of the foot.

The sub-astragalus joint 11 enables the other movements of the ankle, namely the movements of inversion and eversion.

By inversion of the ankle is meant a movement that combines a partial or full combination of all of the following movements in the three spatial planes, namely:

in the horizontal plane P, a rotation called inward rotation, i.e. directed towards the interior face of the opposite foot; this inward rotation has a maximum amplitude of rotation of 30° relative to a normal plumb position of the foot in which the longitudinal axis of the foot is substantially parallel to the sagittal plane of symmetry of the human being;

in the frontal plane, corresponding to a vertical plane F perpendicular to the plane P, an inward rolling with an amplitude of approximately 25° defined relative to the top and bottom extreme amplitude positions of the inward rolling, in the sagittal plane, or the plane of FIG. 5, plantar flexion, with an amplitude of approximately 10° in the direction of the arrow f1 and defined relative to a normal plumb position of a human being situated on a horizontal plane.

The amplitudes indicated above correspond to average values, each amplitude being liable to vary by plus or minus 10° according to the age of the person and their specific anatomical characteristics.

By eversion of the ankle is meant a movement that combines in the three spatial planes, in a general direction away from or departing from the sagittal plane of symmetry of the person:

an outward rotation of 30° maximum in the horizontal plane, in the front plane F, an outward rolling of approximately 20°, in the sagittal plane, a dorsal flexion in the direction of the arrow f2 and with an amplitude of approximately 10°.

Analysis of the movements of the sub-astragalus foot and ankle joint has shown that all these movements of inversion and eversion in the three spatial planes have instantaneous axes of displacement that themselves move in space within a geometrical envelope similar to a circular cone 12 called the sub-astragalus cone.

The apex S of the cone 12 is at a distance d of a few centimeters to the rear of the calcaneum 4 and at a height H1 that is approximately one third of the height H of the posterior side of the calcaneum 4. The median axis 12*a* of the cone 12 passes through the summit S and through the median area of the two bundles of ligaments 13 and 14 that connect the astragalus 5 to the calcaneum 4. It is found that the median axis 12*a* of the sub-astragalus cone 12 is at an angle α to the horizontal plane P from 20° to 50°, more generally from 30° to 45°.

Moreover, the sub-astragalus cone 12 has a cone angle β the average value whereof varies from 15° to 30° according to the age of the person and their anatomical peculiarities.

In a plan view of the foot, i.e. a view from above, the median axis 12*a* of the sub-astragalus cone 12 is also at an angle from 10° to 30° to the sagittal plane, on the interior side, i.e. towards the other foot.

The above considerations thus define an anatomically and physiologically based geometrical and mechanical model substantially representative of the kinematics of the ankle joint.

The shoe according to the invention and the shoe heel cup according to the invention aim to favor the movements thus defined about axes moving in the sub-astragalus cone 12 at the same time as limiting those movements to prevent excessive forces on the joint members at the end of the amplitude of movement and providing good protection of fragile portions of the foot.

According to the invention, to obtain satisfactory freedom of these movements, necessary to obtain sufficient comfort, at the same time as protecting the foot effectively against impact and excess amplitudes of movement, it is necessary to envelop the rear of the foot in a heel cup with lateral cutouts positioned in corresponding relationship to the sub-astragalus cone 12.

Consider FIGS. 1 to 4, which show a heel cup structure 24 of this kind according to the invention.

The heel cup 24 is made from a sheet 15 of an elastically deformable material having sufficient stiffness to constitute a shoe reinforcement. The sheet 15 of this material is delimited by a slightly convex lower edge 16 and a more strongly convex upper edge 17 having two lateral cutouts 18 and 19 disposed symmetrically with respect to a median axis 20 generally perpendicular to the lower edge 16.

There are therefore seen in the figure a central area 21 intended to constitute a posterior tongue in a shoe and two lateral wings 22 and 23.

In practical applications to multipurpose shoes, for a size 42, the sheet 15 may have a length L from approximately 12 to 16 cm and a height H of the central area 21 from approximately 4 to 7 cm.

The lateral cutouts 18 and 19 are oriented along respective axes 18*a* and 19*a* inclined at approximately 45°. The lateral cutouts have an aperture angle 18*b* or 19*b* of approximately 30°. Their respective bottom 18*c* or 19*c* is at a distance d1 of approximately 2 cm from the mid-point M of the lower edge 16.

The lower edge 16 may advantageously comprise at least one V-shaped conformation cutout 16*a*. The confirmation cutout 16*a* enables the two segments constituting the lower edge 16 to move towards each other to impart to the sheet 15 a concavity in the vertical direction to envelop the rear of the foot.

Figure 1:
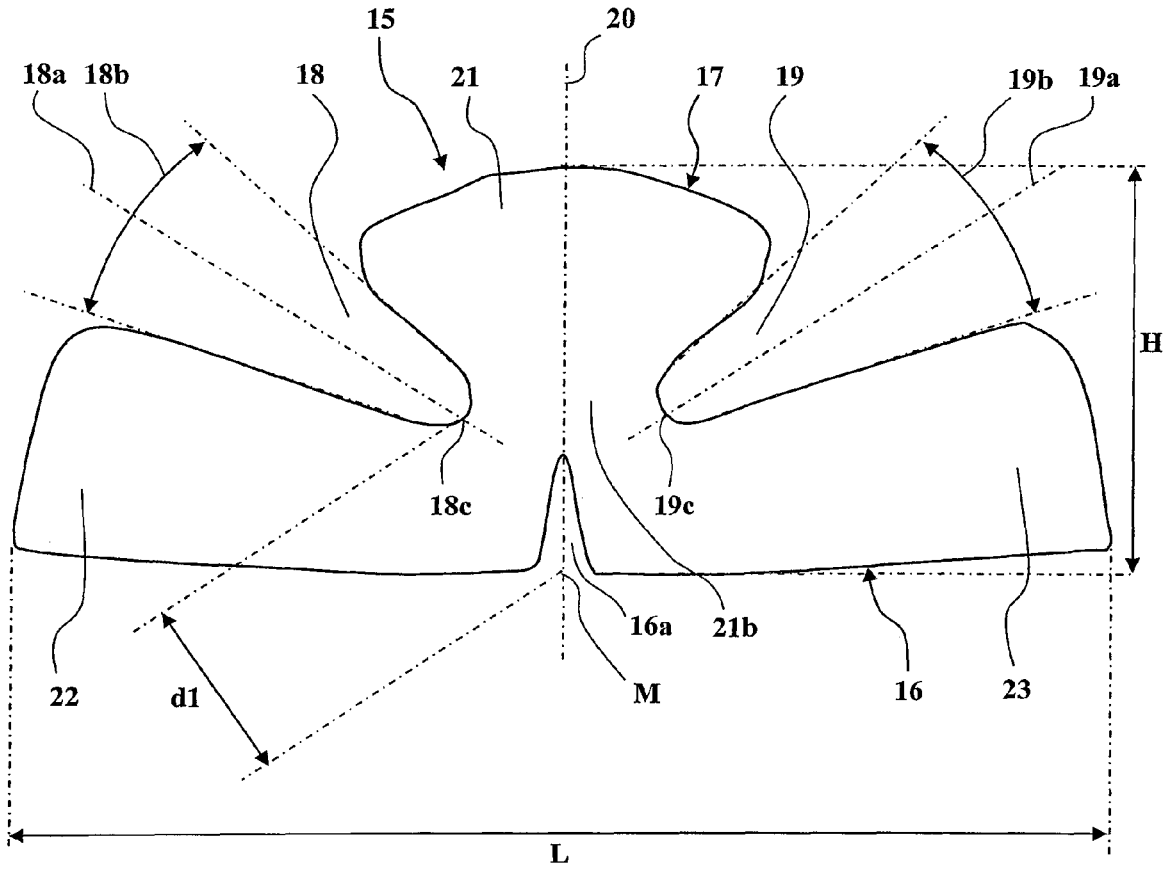
FIG. 1 is a front view in a deployed position of a sheet of material intended to constitute a shoe heel cup according to one embodiment of the present invention.
Figure 2:
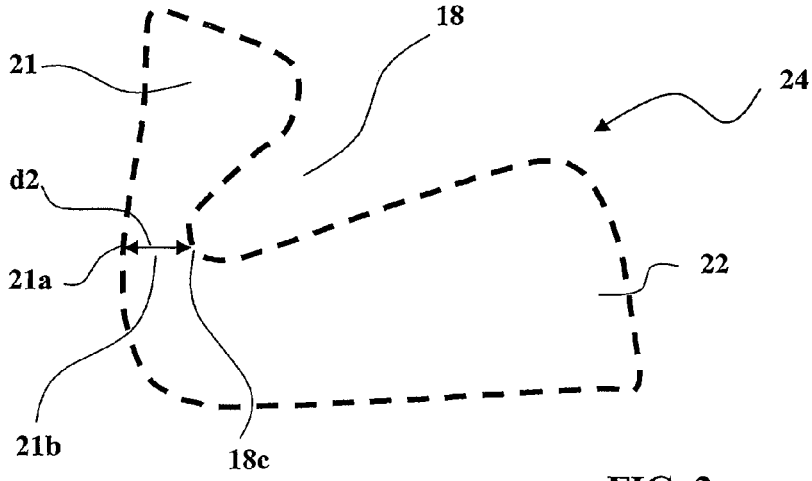
FIG. 2 is a side view of the heel cup produced in accordance with the invention from the FIG. 1 sheet.

FIG. 2 shows the heel cup 24 according to the invention produced from the FIG. 1 sheet 15 by bending the two wings 22 and 23 parallel to each other and moving the two segments of the lower edge 16 towards each other to close up the conformation cutout 16*a*, the central area 21 being curved. Thus there are seen in the figure the wing 22, the central area 21 forming a posterior tongue and the lateral cutout 18, the bottom 18*c* of which is forward of the posterior edge 21*a*, from which it is separated by a narrow connecting area 21*b* of width d2 that is sufficiently wide to have sufficient mechanical properties of elasticity and stiffness to control relative movement between the posterior tongue 21 and the lateral wings 22 and 23.

Figure 3:
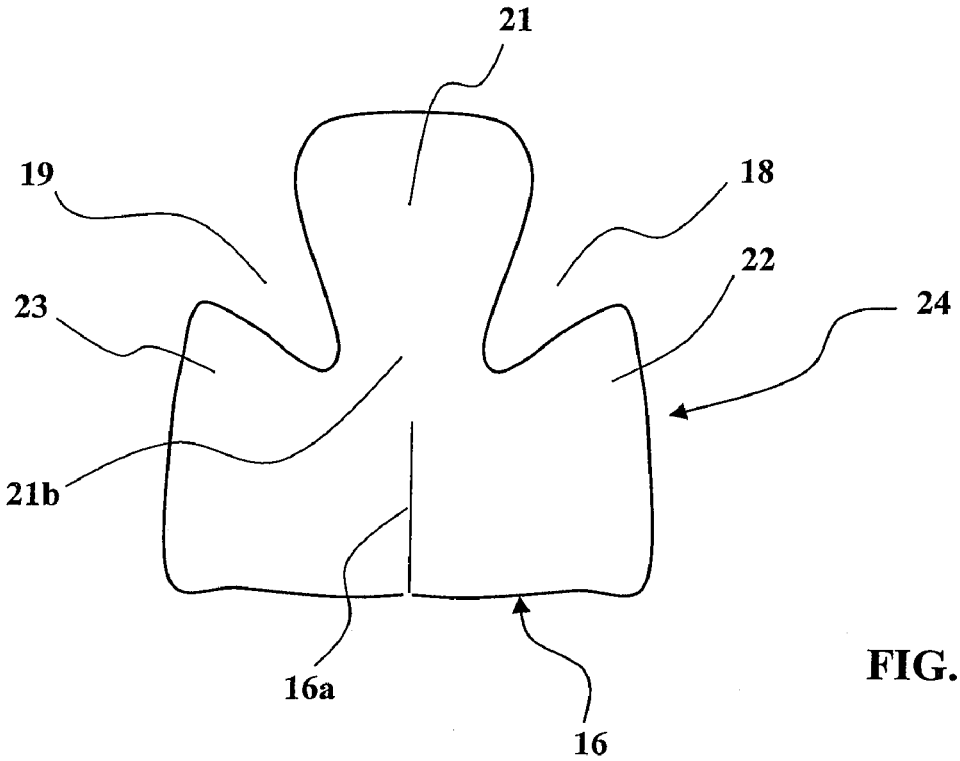
FIG. 3 is a rear view of the FIG. 2 heel cup.

FIG. 3 is a rear view of the FIG. 2 heel cup 24, in which are seen the two wings 22 and 23, the posterior tongue 21, the lateral slots 18 and 19, the connecting area 21*b* and the conformation cutouts 16*a*, the edges whereof are closer together or pressed against each other.

Figure 4:
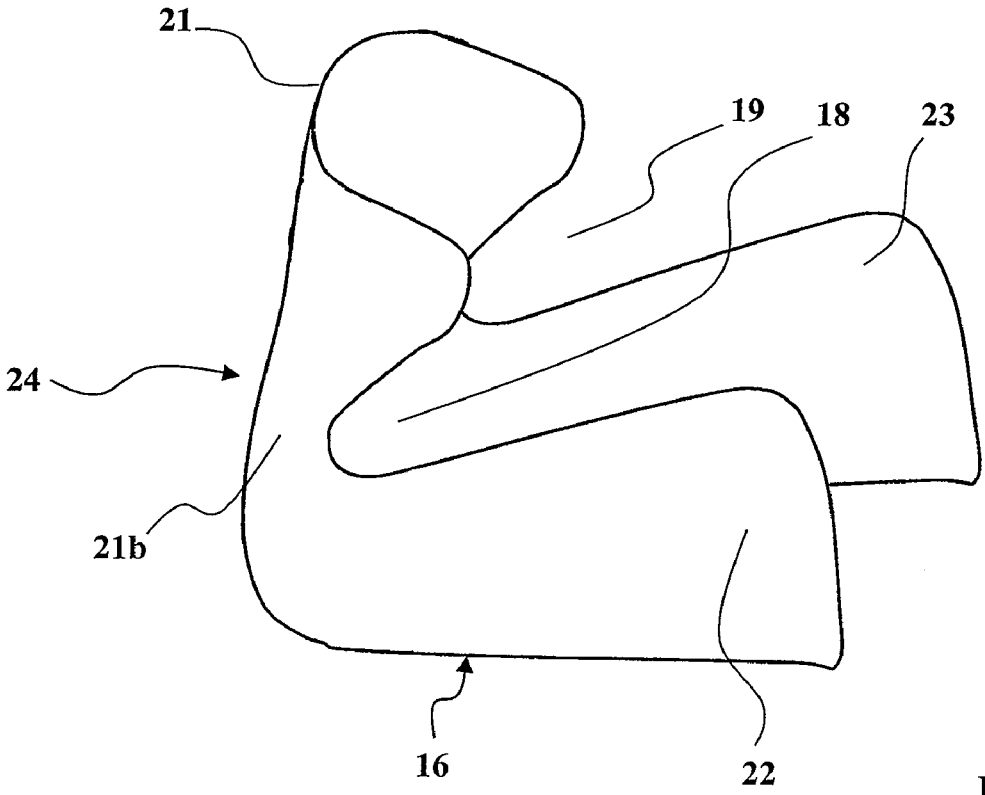
FIG. 4 is a perspective view of the FIG. 2 heel cup.

FIG. 4 is a perspective view of the heel cup in which the same main portions are seen identified by the same reference numbers.

Figure 6:
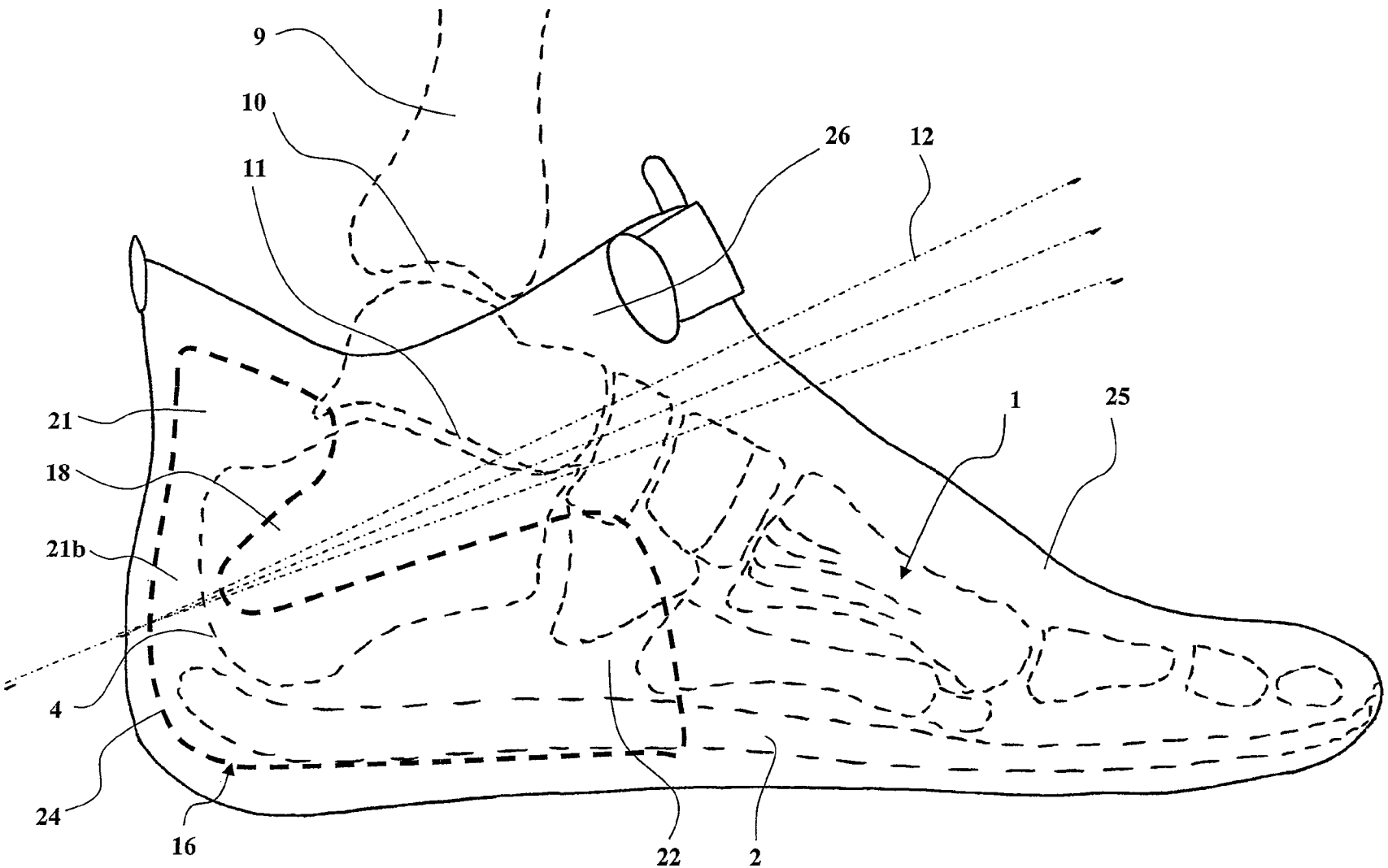
FIG. 6 is a diagrammatic lateral external view of the ankle and foot joint in a shoe provided with a heel cup in accordance with the present invention.

Consider now FIG. 6, which is an external side view of a foot inserted into one embodiment of a shoe according to the invention including the heel cup 24 according to the invention.

The components of the skeleton of the foot previously described with reference to FIG. 5 are seen again.

In FIG. 6, the invention is applied to a multipurpose shoe with a relatively low vamp.

The shoe comprises the sole 2, the heel cup 24, an upper 25 and a vamp 26.

The sole 2 has the usual structure, chosen as a function of the intended uses.

The upper 25 is fixed to the sole 2 and is adapted to envelop the plantar mass of the foot and the calcaneo-pedal block.

The vamp 26, connected to the posterior portion of the upper 25, is adapted to envelop at least the upper posterior area of the foot.

The heel cup 24 is disposed in the shoe to surround the rear portion of the foot, covering at least the whole of the posterior face of the foot from its base to a point above the calcaneum 4. Its lower edge 16 is fixed to the sole 2. The heel cup 24 surrounds the calcaneum 4 laterally.

The posterior tongue 21 and the wing 22 are seen in FIG. 6.

The cutout 18 is oriented substantially to contain the lateral projection of the sub-astragalus cone 12.

As seen in FIG. 6, the posterior tongue 21 rises to a height greater than or equal to the height of the summit area of the calcaneum 4. As shown here, the posterior tongue 21 preferably rises to a height from approximately 2 to 4 cm above the summit area of the calcaneum. This protects the area of the bottom insertions of the Achilles tendon against impact. This also favors the absorption of the forces of rotation of the joint members of the ankle, by distributing the bearing forces between the posterior portion of the foot and the shoe over a greater height.

As seen in the figures, the posterior tongue 21 widens in the upward direction, which laterally envelops the bottom insertions of the Achilles tendon and thus increases the protection thereof against impact.

The side wings such as the wing 22 extend forwards at least to the anterior end area of the calcaneum 4. Their height increases towards the front, which enables them to envelop laterally the anterior area of the calcaneum 4 over substantially all of its height, as seen clearly in FIG. 6.

The heel cup 24 may be made from a material that is elastically flexible but has some stiffness, for example a material based on carbon or a carbon-kevlar type composite material, or even a material based on certain high-density plastic materials.

In contrast, the area of the cutouts 18 and 19, occupied by the upper 25 and/or the vamp 26, must have greater flexibility in order to authorize deformation upon movement of the sub-astragalus joint.

During movement of the joint, and in particular eversion and inversion movements, the lateral cutouts 18 and 19 provide areas of preferential deformation of the shoe, oriented parallel to the sub-astragalus cone 12. Nevertheless, the support of the relatively rigid connecting area 21*b* between the posterior tongue 21 and the lateral wings 22 and 23 produces an elastic return torque that tends to return the foot into the sagittal plane of the tibia, thereby relieving the sub-astragalus joint 11.

At the same time, the resulting heel cup 24 opposes rolling movements of the foot relative to the shoe itself during eversion and inversion movements, by virtue of the fact that the calcaneum 4 is closely enveloped by the heel cup 24. This produces a significant improvement in comfort and greater safety in the event of extreme loads, in particular on turning.

The invention applies to low shoes as shown in FIG. 6, i.e. shoes with a low vamp 26.

It applies equally to shoes with a higher vamp 26, covering the tibio-tarsal joint 10.

It applies equally well to shoes with a flexible upper 25 and to shoes with a plantar shell and rigid vamp, provided that an area of greater flexibility is provided at the level of the cutouts 18 and 19.

For example, good results have been obtained with a shoe as shown in FIG. 6 in which the heel cup 24 is a sheet of semi-rigid plastic material, for example polyurethane, ABS, polyethylene, having a thickness of the order of 1 mm. The heel cup 24, fixed, for example glued, to the sole 2, is preferably accommodated inside the external upper of the shoe and covered internally with protective layers of felt or other material appropriate for contact with the foot 1. Alternatively, the heel cup 24 may constitute an external element, visible on the shoe. The sole 2 may have a conventional structure of polyurethane reinforced with carbon fibers, the upper 25 and the vamp 26 being produced from any deformable material, of the polymer type, or synthetic fabric, or leather, for example, the elasticity whereof may be varied as a function of the type of use.

As a function of the intended use of the shoe, and in particular as a function of the required dynamic loads, uppers 25 and vamps 26 will be chosen that are more flexible if it is required to adapt the shoe to a use producing lower loads or more rigid if it is required to adapt the shoe to a use producing higher loads.

Thus there may be expected a very significant reduction in the risk of injury by twisting of the foot and ankle joints during sports or even when walking. At the same time, comfort is considerably improved.

The present invention is not limited to the embodiments that have been explicitly described and includes variants and generalizations thereof that fall within the scope of the following claims.

The invention claimed is:

1. Shoe heel cup, comprising an elastically deformable material sheet of sufficient stiffness to constitute a shoe reinforcement, conformed to surround a posterior portion of a foot and cover at least a whole of a posterior face of the foot from its base to a point above a calcaneum of the foot and extending forwardly, with a lower edge adapted to be fixed to a shoe sole, the sheet comprising an upper edge with two lateral cutouts that are symmetrical with respect to each other, wherein the lateral cutouts are oriented so that, when the heel cup is in place in the shoe, the lateral cutouts are substantially at the level of the lateral projections of the sub-astragalus cone and the sheet laterally surrounds the calcaneum, wherein the lateral cutouts are oriented along respective axes inclined at approximately 45° relative to the lower edge, have an aperture angle of approximately 30°, and each has a bottom being at a distance of approximately 2 cm from a mid-point of the lower edge.

2. Heel cup according to claim 1, wherein the lateral cutouts have a V-shape that diverges away from the lower edge and away from a portion surrounding the posterior portion of the foot.

3. Heel cup according to claim 1, wherein the lateral cutouts have a depth towards the lower edge and towards a portion surrounding the posterior portion of the foot such that, when the heel cup is in place in the shoe, the bottom of the lateral cutouts is slightly to the rear of the sub-astragalus joint.

4. Heel cup according to claim 1, wherein, for a shoe size 42, the heel cup is made from a sheet of material delimited by a slightly convex lower edge of length from approximately 12 to 16 cm and by a more strongly convex upper edge including the two lateral cutouts, the sheet comprising a central area having a height from approximately 4 to 7 cm.

5. Heel cup according to claim 1, wherein the lower edge comprises at least one V-shaped conformation cutout.

* * * * *